US010662641B2

(12) United States Patent
Brekke

(10) Patent No.: US 10,662,641 B2
(45) **Date of Patent: *May 26, 2020**

(54) ANTI-SHEARING CONNECTION OF STRUCTURAL MEMBERS

(71) Applicant: Columbia Insurance Company, Omaha, NE (US)

(72) Inventor: Steven Brekke, Lakeville, MN (US)

(73) Assignee: Columbia Insurance Company, Omaha, NE (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/116,736

(22) Filed: Aug. 29, 2018

(65) Prior Publication Data

US 2019/0078320 A1 Mar. 14, 2019

Related U.S. Application Data

(63) Continuation of application No. 15/353,943, filed on Nov. 17, 2016, now Pat. No. 10,072,412.

(51) Int. Cl.

| | |
|---|---|
| ***E04B 1/38*** | (2006.01) |
| ***E04B 1/41*** | (2006.01) |
| ***B21D 47/00*** | (2006.01) |
| ***E04B 1/26*** | (2006.01) |
| ***B21D 53/36*** | (2006.01) |
| ***E04B 1/18*** | (2006.01) |
| *E04B 1/24* | (2006.01) |

(52) U.S. Cl.

CPC ..... *E04B 1/40* (2013.01); *B21D 47/00* (2013.01); *B21D 53/36* (2013.01); *E04B 1/185* (2013.01); *E04B 1/2612* (2013.01); *E04B 2001/2415* (2013.01); *E04B 2001/405* (2013.01)

(58) Field of Classification Search

CPC ..... E04B 1/40; E04B 1/185; E04B 1/2612; E04B 2001/405; E04B 2001/2415; B21D 53/36; B21D 47/00

USPC ..... 52/702

See application file for complete search history.

(56) References Cited

U.S. PATENT DOCUMENTS

| | | | |
|---|---|---|---|
| 3,601,428 | A | 8/1971 | Gilb |
| 4,411,548 | A | 10/1983 | Tschan |
| 4,480,941 | A | 11/1984 | Gilb et al. |
| 4,569,451 | A | 2/1986 | Parrott et al. |
| 4,802,316 | A | 2/1989 | Kelly et al. |
| 5,555,694 | A | 9/1996 | Commins |
| 5,564,248 | A | 10/1996 | Callies |
| 6,398,259 | B1 | 6/2002 | Palmer et al. |

(Continued)

*Primary Examiner* — Basil S Katcheves
(74) *Attorney, Agent, or Firm* — Stinson LLP

(57) ABSTRACT

A hanger for connecting a structural member to a structural support including a base sized and shaped for receiving the structural member thereon. First and second side panels extend upward from the base. First and second back panels each extend from a respective one of the side panels. First and second top flanges each extend from a respective one of the back panels. An opening in one of said first and second side panels and said first and second back panels is configured to receive a fastener to attach the hanger to one of the structural member and the structural support. A slot is adjacent the opening. An area between the opening and the slot defines a yieldable portion selected to deform at a load that is less than the shear load capacity of the fastener when received through the opening for connecting the hanger to one of the structural member and the structural support.

15 Claims, 11 Drawing Sheets

(56) References Cited

U.S. PATENT DOCUMENTS

| | | | |
|---|---|---|---|
| 6,405,916 | B1 | 6/2002 | Olden |
| 7,334,372 | B2 | 2/2008 | Evans et al. |
| 8,250,827 | B2 | 8/2012 | Lin et al. |
| 9,206,594 | B1 | 12/2015 | Grevious et al. |
| 2003/0009980 | A1 | 1/2003 | Shahnazarian |
| 2006/0081743 | A1 | 4/2006 | Evans et al. |
| 2008/0101855 | A1 | 5/2008 | Lin |
| 2008/0150342 | A1 | 6/2008 | Kismarton et al. |
| 2015/0167291 | A1 | 6/2015 | Bundy et al. |

ANTI-SHEARING CONNECTION OF STRUCTURAL MEMBERS

CROSS-REFERENCE TO RELATED APPLICATION

This application is a continuation of U.S. application Ser. No. 15/353,943, filed Nov. 17, 2016, the entire contents of which are incorporated herein by reference.

FIELD OF THE INVENTION

The present invention generally relates to connections for structures, and more specifically, a joist hanger for connecting a joist to a header.

BACKGROUND

The use of hangers to attach structural members (e.g., joists) to structural supports (e.g., headers) is commonplace. When constructing a structure, users must install many hangers to attach the joists to the headers throughout the building. Typically, a user must align a hanger in the desired position and hold it there while fasteners (e.g., screws) are inserted to mount the hanger on the header. Screws may also be used to attach the joist to the hanger. In a conventional application, screws are received through top flanges of the header into an upper surface of the header. In addition, screws are received through flanges of the hanger that engage a side surface of the header. An end of a joist is placed onto a seat of the hanger and screws are driven through openings in side panels of the seat into the joist to secure the joist to the hanger.

In one aspect of the present invention, an anti-shearing construction connector for connecting a first structural member to a second structural member using one or more fasteners so as to inhibit shearing off said one or more fasteners by the construction connector generally comprises a first connection portion configured to attach to the first structural member and a second connection portion connected to the first connection portion. The second connection portion is configured to be attached to the second structural member using said one or more fasteners for transferring loads between the first and second structural members when the construction connector connects the first and second structural members. The second connection portion includes one or more yieldable portions, each yieldable portion partially defining an aperture in the second connection portion. The aperture is configured to receive one of said one or more fasteners to attach the second connection portion to the second structural member. Each yieldable portion is configured to change a dimension of the aperture by deforming at a load that is less than a shear load capacity of the fastener received through the aperture when the fastener engages the yieldable portion and less than a shear load capacity of the second connection portion adjacent to the yieldable portion.

SUMMARY

In another aspect of the present invention, a connector for supporting a first structural member by transferring a load exerted by the first structural member to a second structural member generally comprises a first connection portion configured to attach to the first structural member so that the first structural member exerts the load on the first connection portion. A second connection portion of the connector is fixed to the first connection portion so that the load exerted by the first structural member on the first connection portion is exerted on the second connection portion. The second connection portion is configured to attach to the second structural member so that the second connection portion exerts the load on the second structural member. The second connection portion generally comprises an aperture configured to receive a fastener to attach the second connection portion to the second structural member, and a yieldable portion partially defining the aperture. The yieldable portion is selected to deform at a deformation load that is less than a shear load capacity of the fastener received through the aperture when the yieldable portion engages the fastener. The yieldable portion is positioned relative to the aperture so that at least a portion of the load is exerted on the fastener by the yieldable portion when the second connection portion exerts the load on the second structural member.

In yet another aspect of the present invention, a connector for connecting a first structural member to a second structural member using one or more fasteners generally comprises a first connection portion configured to attach to the first structural member, and a second connection portion connected to the first connection portion. The second connection portion is configured to attach to the second structural member. The second connection portion defines an aperture configured to receive one of the fasteners to attach the second connection portion to the second structural member, and a slot adjacent the aperture. The slot is sized and shaped so that the fasteners are inhibited from being received in the slot. The slot and the aperture are shaped and arranged relative to each other to define a yieldable portion of the second connection portion selected to deform at a load that is less than the shear load capacity of the fastener when received through the aperture for connecting the construction connector to the second structural member.

In yet another aspect, a method of making a hanger for connecting a structural member to a structural support so as to decrease a difference in shear load carried by fasteners connecting the hanger to the structural member and the structural support comprises forming from a blank of sheet metal a channel-shaped portion sized for receiving and supporting the structural member. Back flanges are formed from the blank of sheet and extend from the channel-shaped portion. Openings are formed in the channel-shaped portion and the back flanges. Slots formed adjacent each opening are positioned relative to the adjacent opening to define a yieldable portion selected to deform at a load that is less than the shear load capacity of the fastener when received through the opening for connecting the hanger to one of the structural member and the structural support.

Other objects and features will be in part apparent and in part pointed out hereinafter.

BRIEF DESCRIPTION OF THE DRAWINGS

Corresponding reference characters indicate corresponding parts throughout the drawings.

DESCRIPTION OF THE PREFERRED EMBODIMENTS

Figure 1:
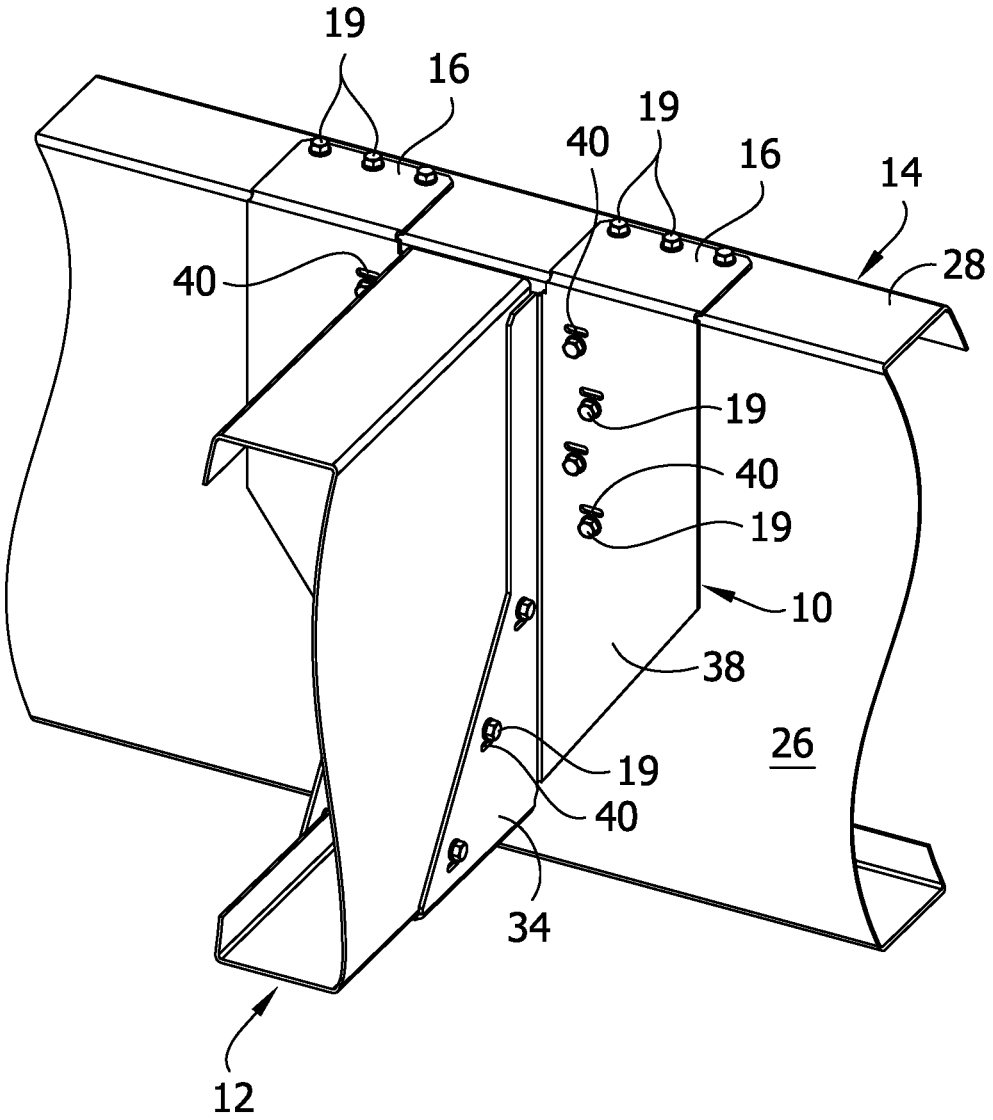
FIG. 1 is a fragmentary perspective of a joist connected to a header by a hanger according to the present invention.
Figure 2:
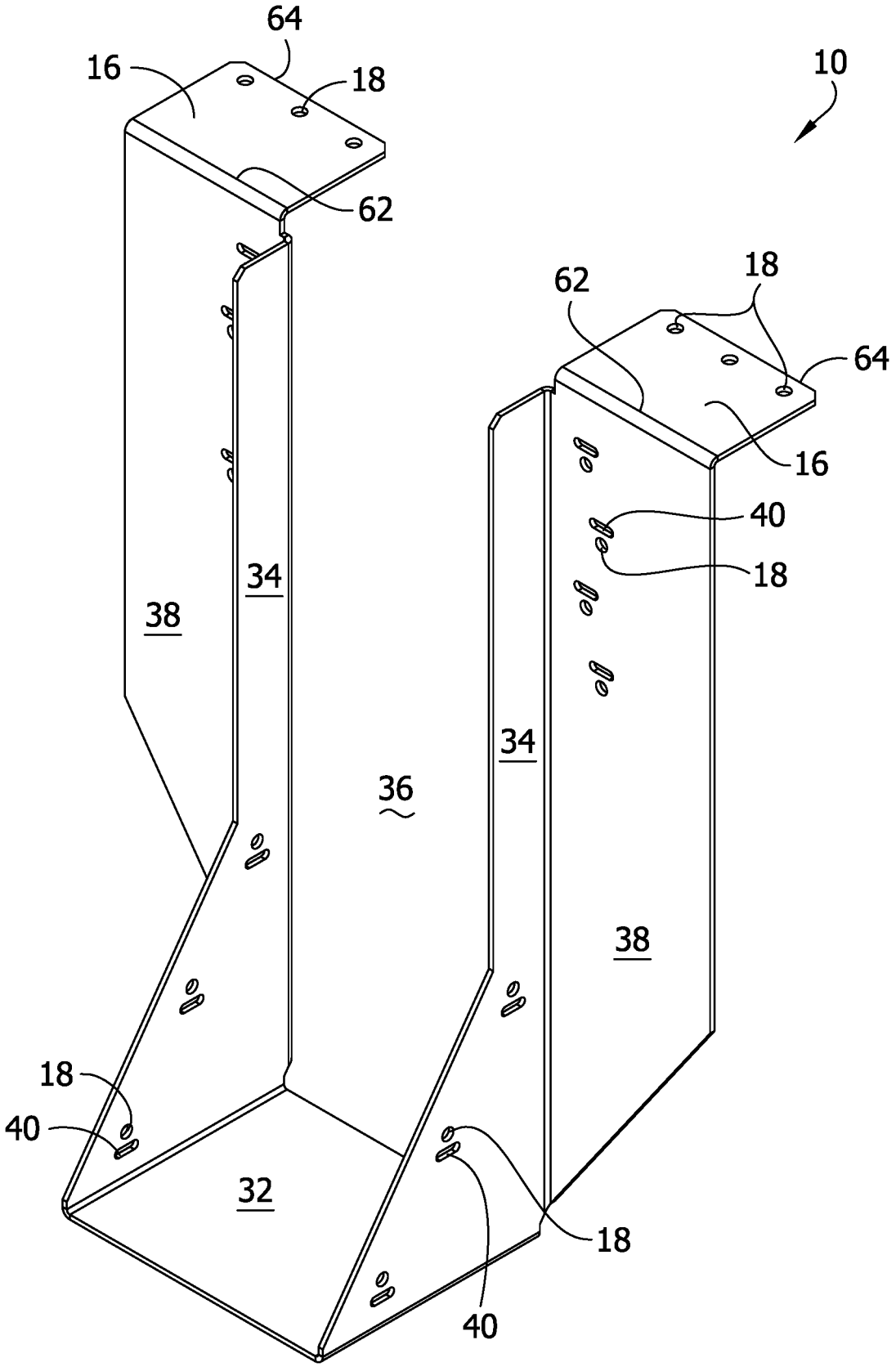
FIG. 2 is a perspective of a hanger according to the present invention.
Figure 3:
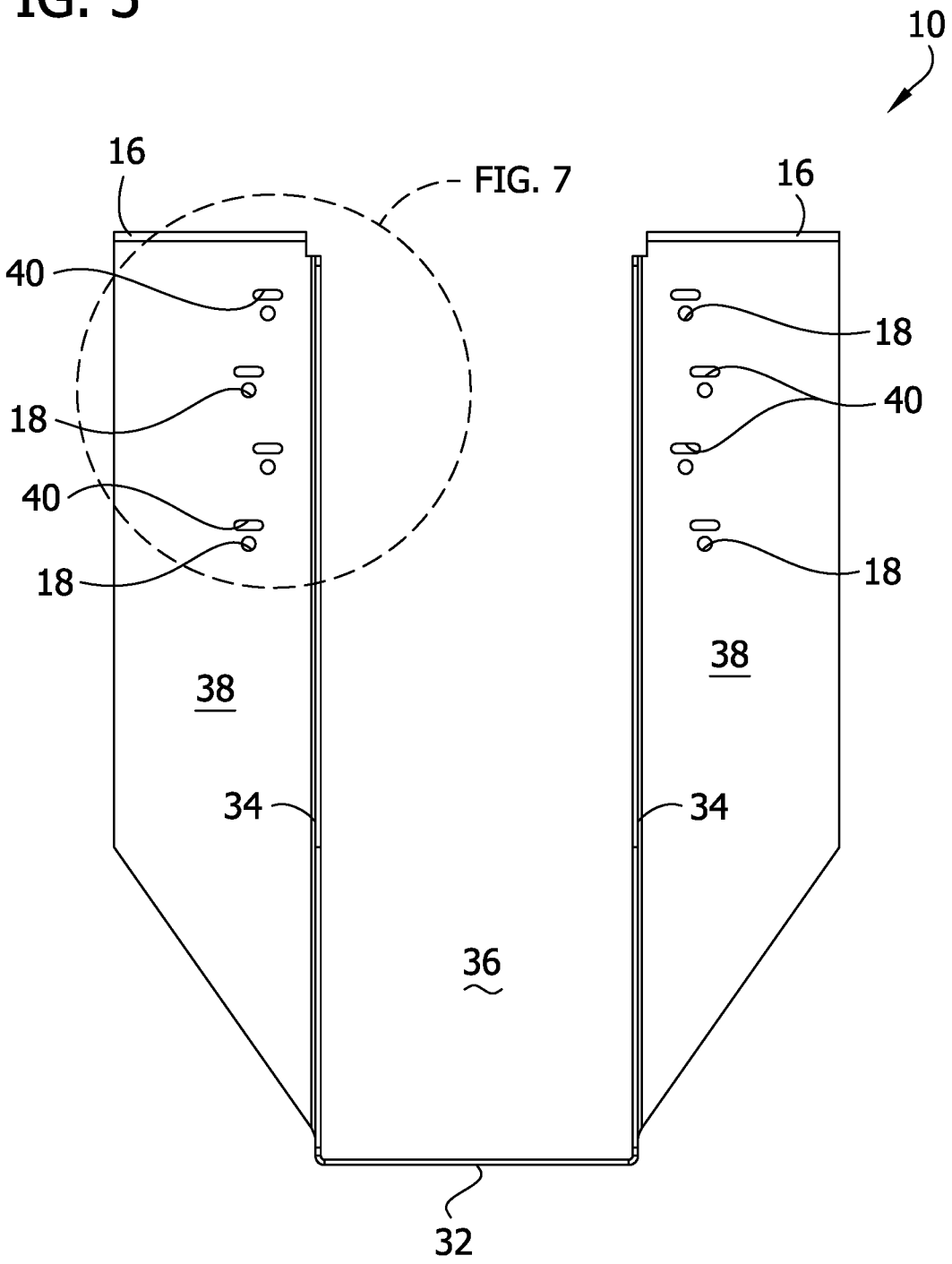
FIG. 3 is a front elevation thereof.
Figure 4:
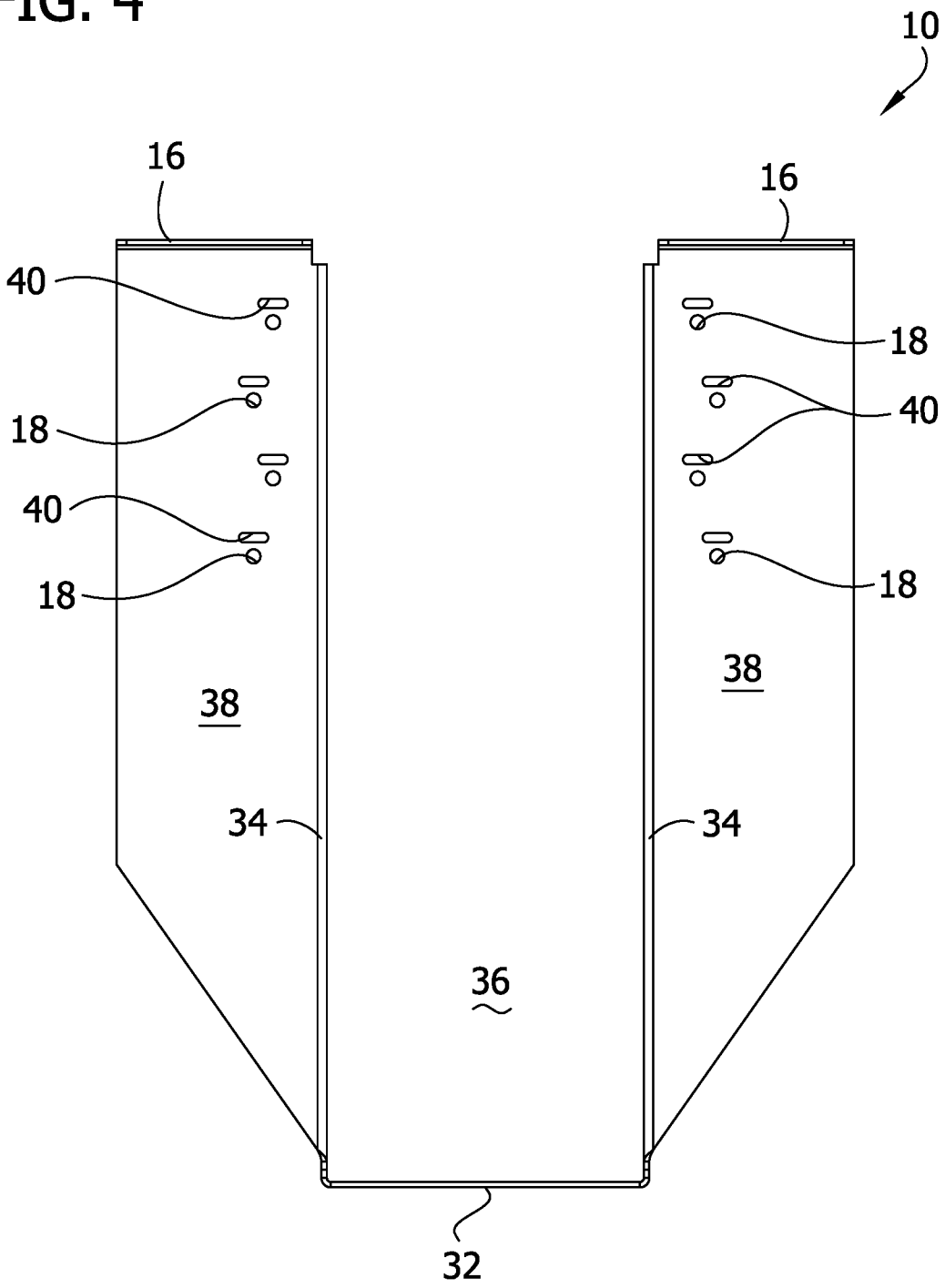
FIG. 4 is a rear elevation thereof.
Figure 5:
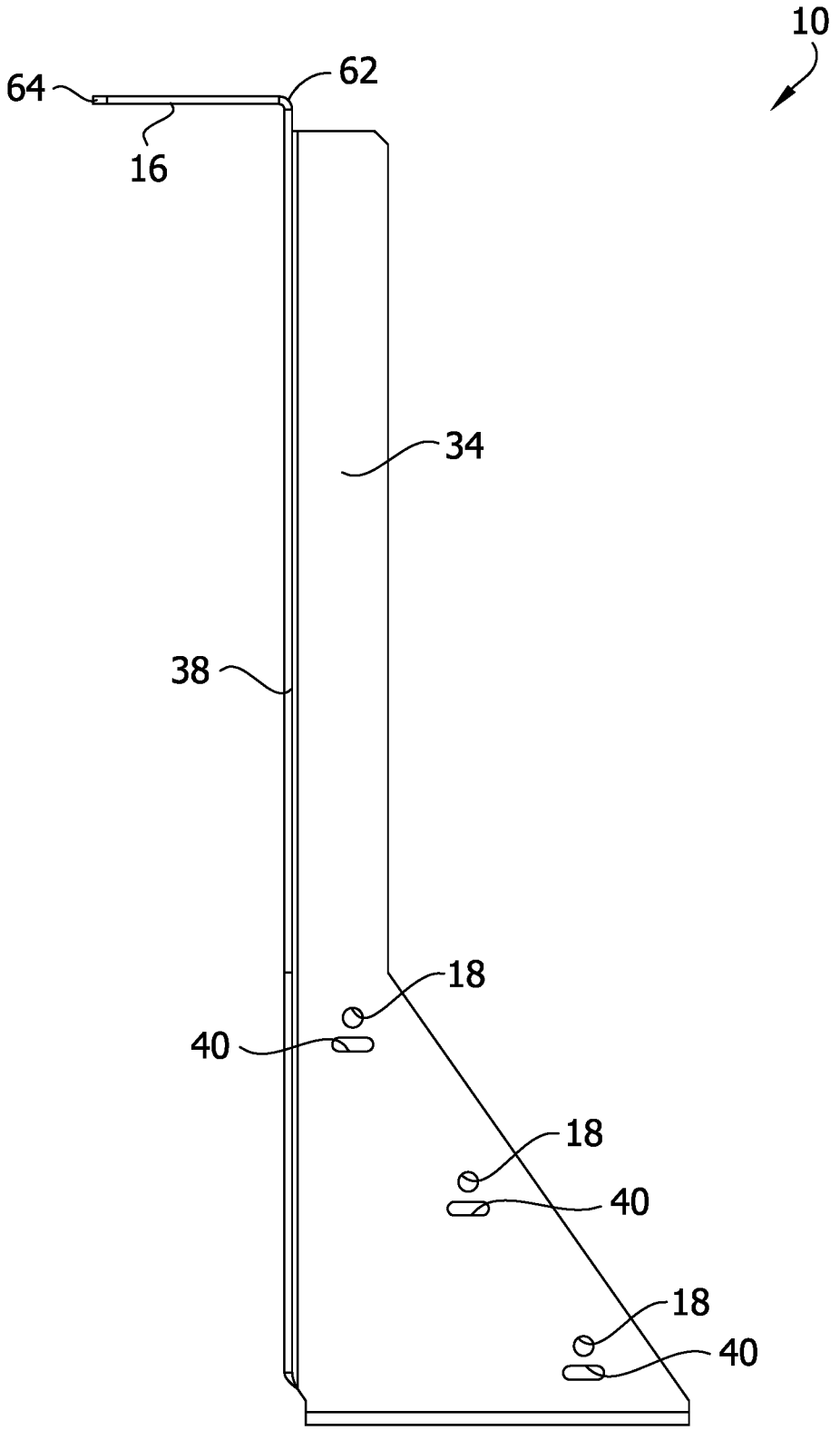
FIG. 5 is a left side elevation thereof.
Figure 6:
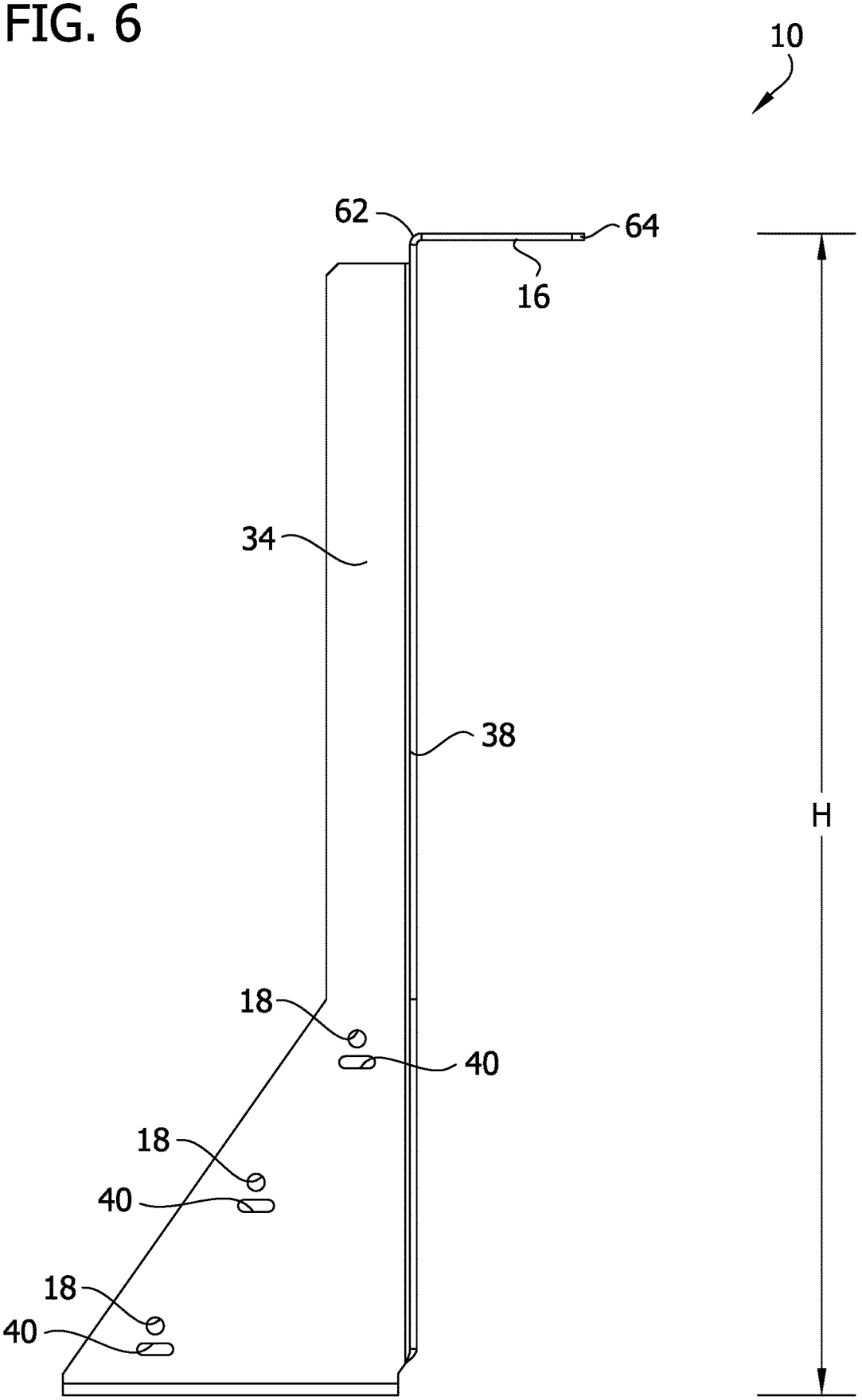
FIG. 6 is a right side elevation thereof.

Referring to FIGS. 1 and 2, a hanger for a cold-formed steel structural member (e.g., a joist) is shown generally at 10. The hanger 10 is configured to connect a joist 12 to a structural support such as header 14, and includes top flanges 16 with fastener holes 18 configured to receive fasteners (e.g., screws) 19 to attach the hanger to the header. In the illustrated embodiment, the joist 12 is a cold-formed steel joist. The joist 12 can be of any suitable construction, including without limitation, solid sawn, structural composite lumber, or multi-ply truss wood framing. As shown, the joist 12 is a single 2×10 cold-formed steel joist although multiple joists in side-by-side relation may be used. The type and size of joist 12 may vary from the illustrated embodiment without departing from the scope of the invention, as a hanger 10 according to the present invention is readily applicable to other joist configurations (e.g. a larger or smaller joist). Moreover, the hanger 10 may be used to connect structural members other than joists to the stud of a wall or other part of a structure. As shown, the header 14 is a single cold-formed steel header although headers formed by two or more pieces of cold-formed steel (or other suitable material) may be used. The header 14 has a front face 26 and a top surface 28. The joist 12 is mounted on the header 14 adjacent the front face 26 by the hanger 10. The hanger 10 is stamped from 12-14 gauge steel, although other suitable gauges and materials are within the scope of the present invention. In one embodiment, the hanger 10 has a height H of about 10 inches (25 cm). Other dimensions of the hanger are also envisioned.

Referring to FIGS. 2-9, the hanger 10 includes a seat or base 32 and a pair of side panels 34 extending upward from the base. When installed, the base 32 is generally horizontal, and the side panels 34 extend generally vertical from the base. The base 32 and side panels 34 are orthogonal to each other and form a channel 36 configured to receive the joist 12. The side panels 34 include inner major surfaces that face toward the joist 12 when received in the hanger 10. A back flange or panel 38 extends from each of the side panels 34. Each back panel 38 is generally perpendicular to both the side panels 34 and the base 32. When installed, each back panel 38 has a major surface extending generally parallel to the front face 26 of the header 14 for flush engagement with the front face. The top flange 16 extends from a first end 62 contiguous with the back panel 38 to a free end 64 opposite the first end. Each top flange 16 is generally perpendicular to the side panels 34 and the back panels 38, and generally parallel to the base 32.

Figure 7:
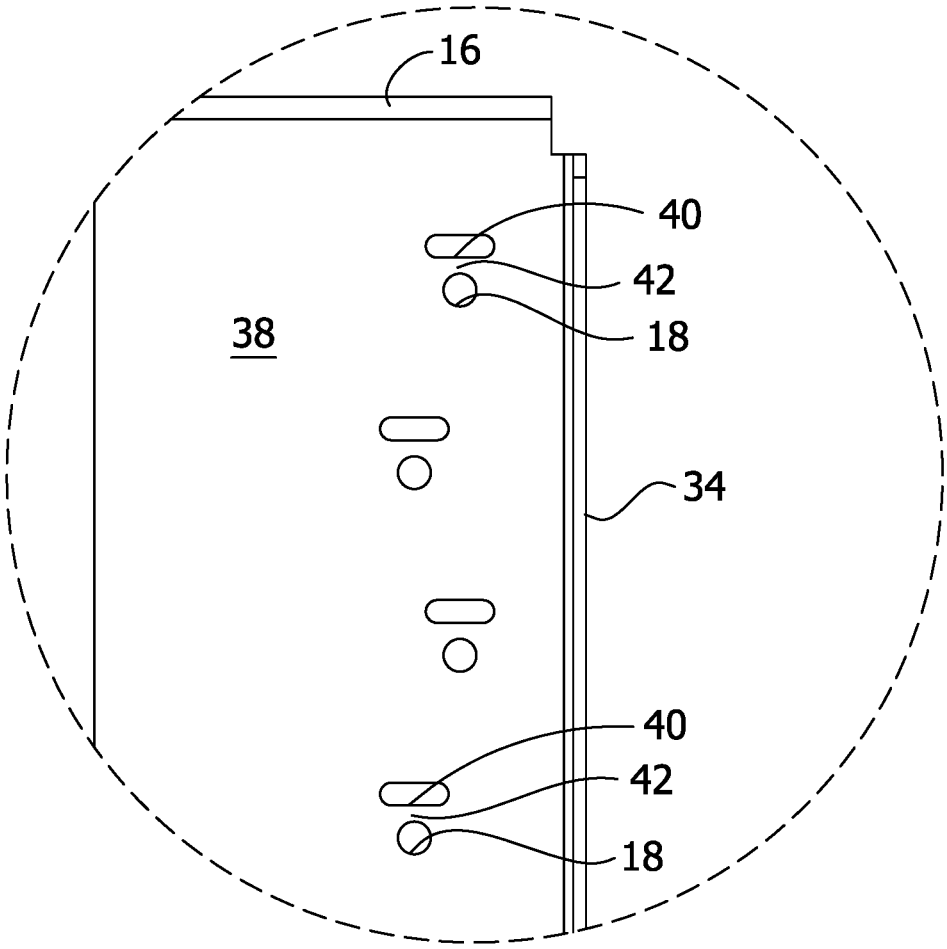
FIG. 7 is an enlarged fragmentary perspective of FIG. 3.
Figure 7A:
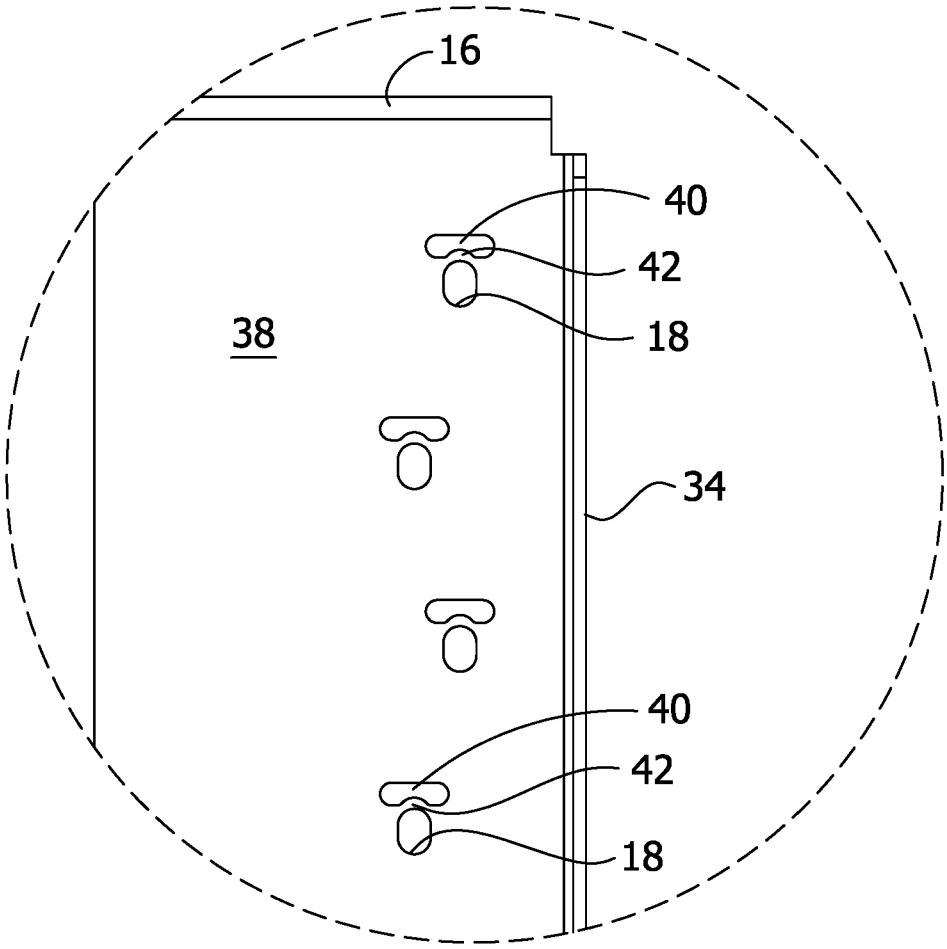
FIG. 7A is the enlarged fragmentary perspective of FIG. 7 showing openings in the hanger after loading.
Figure 8:
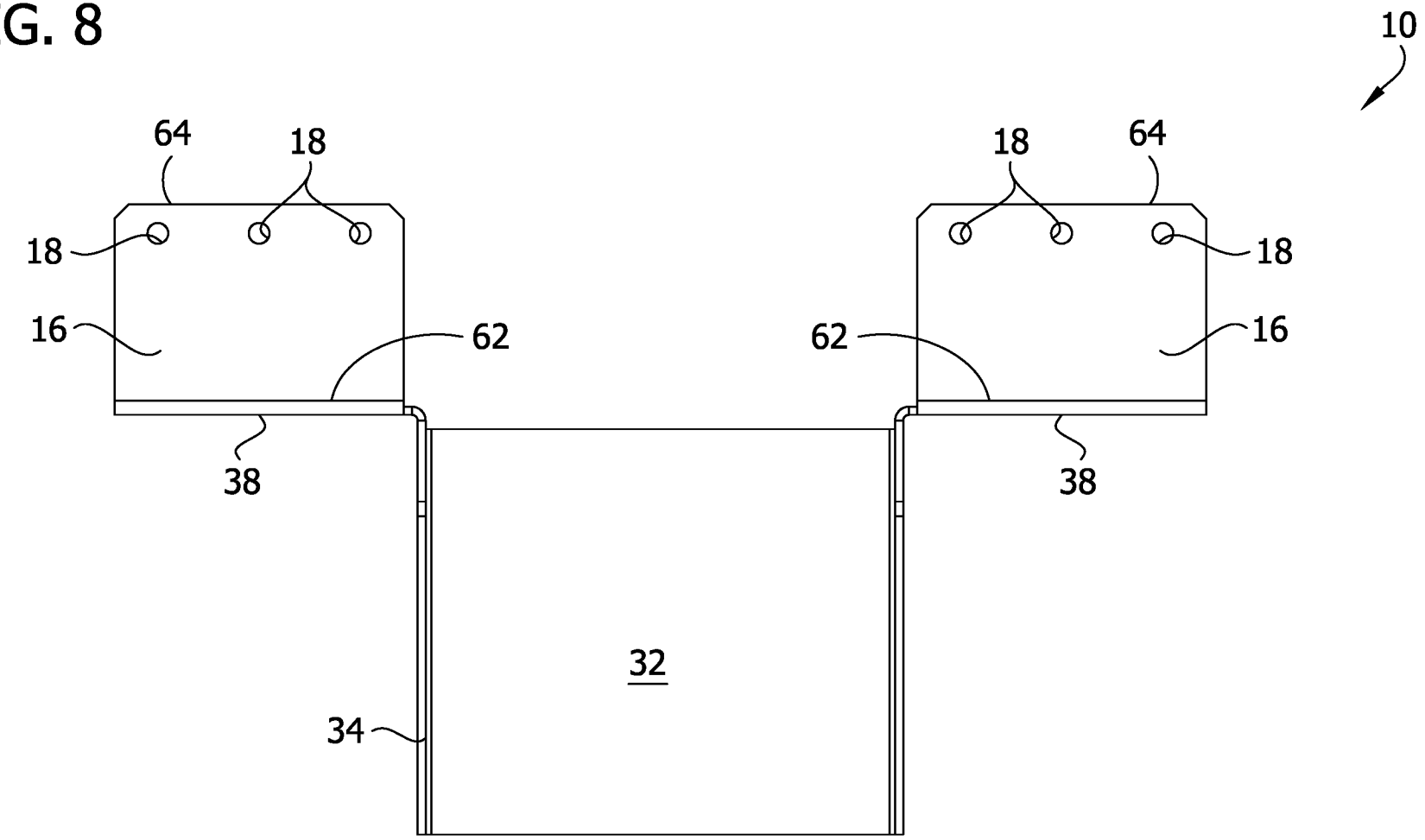
FIG. 8 is a top plan view of the hanger.
Figure 9:
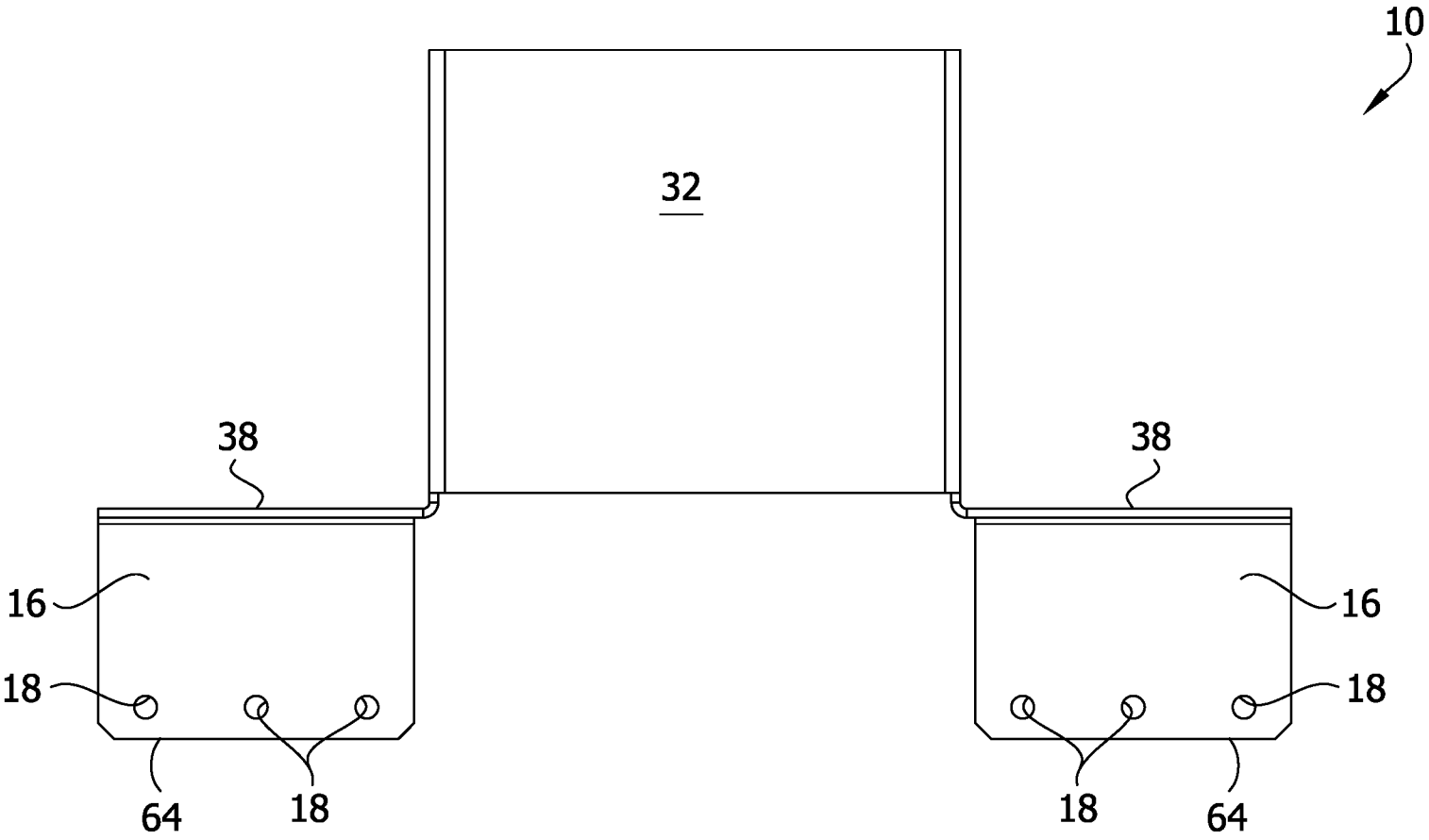
FIG. 9 is a bottom plan view thereof.

The side panels 34 and back panels 38 each have fastener holes 18 and energy dissipation slots 40 adjacent each fastener hole. The dissipation slots 40 comprise elongate openings positioned adjacent to respective fastener holes 18. The dissipation slots 40 are located nearer to the base 32 than their adjacent openings 18 in the side panels 34. In the back panels 38, the slots 40 are located farther from the base 32 than their adjacent openings 18. A region of the back panels 38 defined between each opening 18 and the dissipation slot 40 comprises a yieldable portion 42 (FIGS. 7 and 7A). The yieldable portions 42 are sized and shaped to deform and permit relative movement between the hanger 10 and the screws 19 without shearing off the screws, as will be explained in greater detail below. The openings 18 and dissipation slots 40 are arranged in the back panels 38 so that the pairs of adjacent openings and slots are staggered along the height of the back panel. Pairs of adjacent openings 18 and slots 40 in the side panels lie along a common axis. The common axis is skew with respect to the plane of the base 32 and also with respect to a plane including the back panels 38. Other arrangements of the pairs of openings and slots may be used within the scope of the present invention.

In one embodiment, the hanger 10 is positioned on the header 14 so that the top flanges 16 engage the top surface 28 of the header. Once the hanger 10 is placed in the desired position on the header 14, screws 19 are driven through the fastener openings 18 in the top flanges into the top surface 28 of the header 14, thereby assuring the hanger 10 remains in the desired position. Screws 19 are inserted through the fastener holes 18 in the back panels and driven into the front face 26 of the header 14. Then, the joist 12 is inserted into the channel 36 so that the bottom of the joist engages the base 32 of the hanger 10. The hanger 10 is fastened to the joist 12 by screws 19 extending through fastener holes 18 in one of the side panels 34 and into the side of the joist. It will be understood that screws may be inserted through both side panels depending upon the construction of the joist 12. The hanger 10 is thus secured to both the joist 12 and the header 14, thereby mounting the joist on the header. It will be appreciated that variation in the order of connections made can be employed. In the illustrated embodiment, the fastener openings 18 are about 0.18 inches (0.46 cm) in diameter, and the screws 19 are #10 screws. Fastener openings and screws of other sizes may be used within the scope of the present invention. In one embodiment the slots have a length of about 0.375 inches (0.953 cm) and a height of about 0.125 inches (0.318 cm). The height of the slot 40 is less than the diameter of the fastener holes 18 so that the slot is not sized to receive a screw 19. This prevents a user from improperly inserting a fastener into the slots allowing the slots to serve their intended purpose. In one embodiment, a distance between the slot 40 and an adjacent fastener hole 18 is less than the diameter of the fastener hole.

In one embodiment, each yieldable portion 42 is configured to resist about 75% to about 90% of a fastener capacity of the adjacent screw 19, as determined by the American Iron and Steel Institute, AISI Standard, North American Specification for the Design of Cold-Formed Steel Structural Members and AISI S100-12-C, 2012 Edition, herein incorporated by reference. The yieldable portions 42 will deform without breaking into the slots 40 when the load reaches a level above their ability to resist. This allows movement of the screws 19 relative to the hanger 10 and shields the screws from higher loads that could cause them to be sheared off.

The joist 12 will be required to support loads after it is mounted on the header 14. Loads applied to the joist 12 in bearing are transferred to the hanger 10 through the base 32 and by the screws 19 where they engage the side panels 34 adjacent the openings 18. If the bottom surfaces of the top flanges 16 are not in flush engagement with the upper surface 28 of the header 14, the hanger 10 will tend to move downward with respect to the header until the bottom surfaces of the top flanges substantially conformally engage the upper surface of the header. The downward movement is small, but applies a large force against the screws 19 connecting the back panels 38 to the front face 26 of the header 14. Referring to FIG. 7, the downward force is applied to the screws 19 by the yieldable portions 42. Therefore instead of shearing off the screw heads if the loads exceed the capacities of the screws 19, the yieldable portions 42 deform to permit the relative movement. Similarly, if rear surfaces of the back panels 38 are not in flush engagement with the front face 26 of the header 14, the back panels will pivot downward until substantially conformal engagement of the rear surfaces of the back panels with the front face of the header is achieved. This movement also tends to cause the back panels 38 to move downward with respect to the header. Again, the downward loads are applied to the screws 19 that are fixed to the header 14 by the yieldable portions 42 of the hanger 10. Therefore, the yieldable portions 42 deform rather than apply a load great enough to shear off the screw heads. Deformation of the openings 18 in the back panels 38 of the type described is illustrated in FIG. 7A. It will be appreciated that the screws 19 have been removed in FIG. 7A to better disclose the deformation of the yieldable portion 42.

It will be understood that the downward movement of the hanger 10 relative to the header 14 can be as a result of either lack of flush engagement of the top flanges 16 with the upper surface 28 of the header 14 or lack of flush engagement of the back panels 38 with the front face 26 of the header, or may be a combination of the two. Lack of conformal engagement of either the top flanges 16 or the back panels 38 may be caused, for example, by the way in which the hanger 10 is applied to the header, or by a difference in the angle between the top flanges and the back panels and the angle between the upper surface of the header and the front face of the header. Many of the hangers 10 used in a structure may have full conformal engagement with the header 14 so that little or no movement of the hanger will occur.

Pivoting movement of the hanger 10 can cause the angle of the base 32 to change with respect to the bottom of the joist 12. This can cause the joist 12 to move downward slightly with respect to the hanger 10. Movement of the joist 12 relative to the hanger 10 applies loads via the screws 19 to the side panels 34 of the hanger. The loads are resisted by the yieldable portions 42 defined between the openings 18 and the slots 40 in the side panels 34. Before the load exceeds the capacity of the screws 19, the yieldable portions will deform without breaking downward into the slots 40 to accommodate movement of the screws and preventing failure of the screws in shear. In one embodiment, the yieldable portions 42 associated with both the side panels 34 and the back panels 38 are constructed to permit relative movement of the screws up to about ⅛ inch (0.32 cm) without failing.

Additionally, the construction of the hanger 10 allows for #10 screws to be used for both attaching the hanger to the header 14 and for attaching the joist 12 to the hanger. This alleviates the need to compensate for small movement of the hanger by using larger screws, such as #14 screws or larger, for attaching either the hanger 10 to the header 14 or the joist 12 to the hanger. Thus, the hanger 10 is able to function as well, if not better, with smaller screws than hangers that do not have the current design but that use larger screws.

Figure 10:
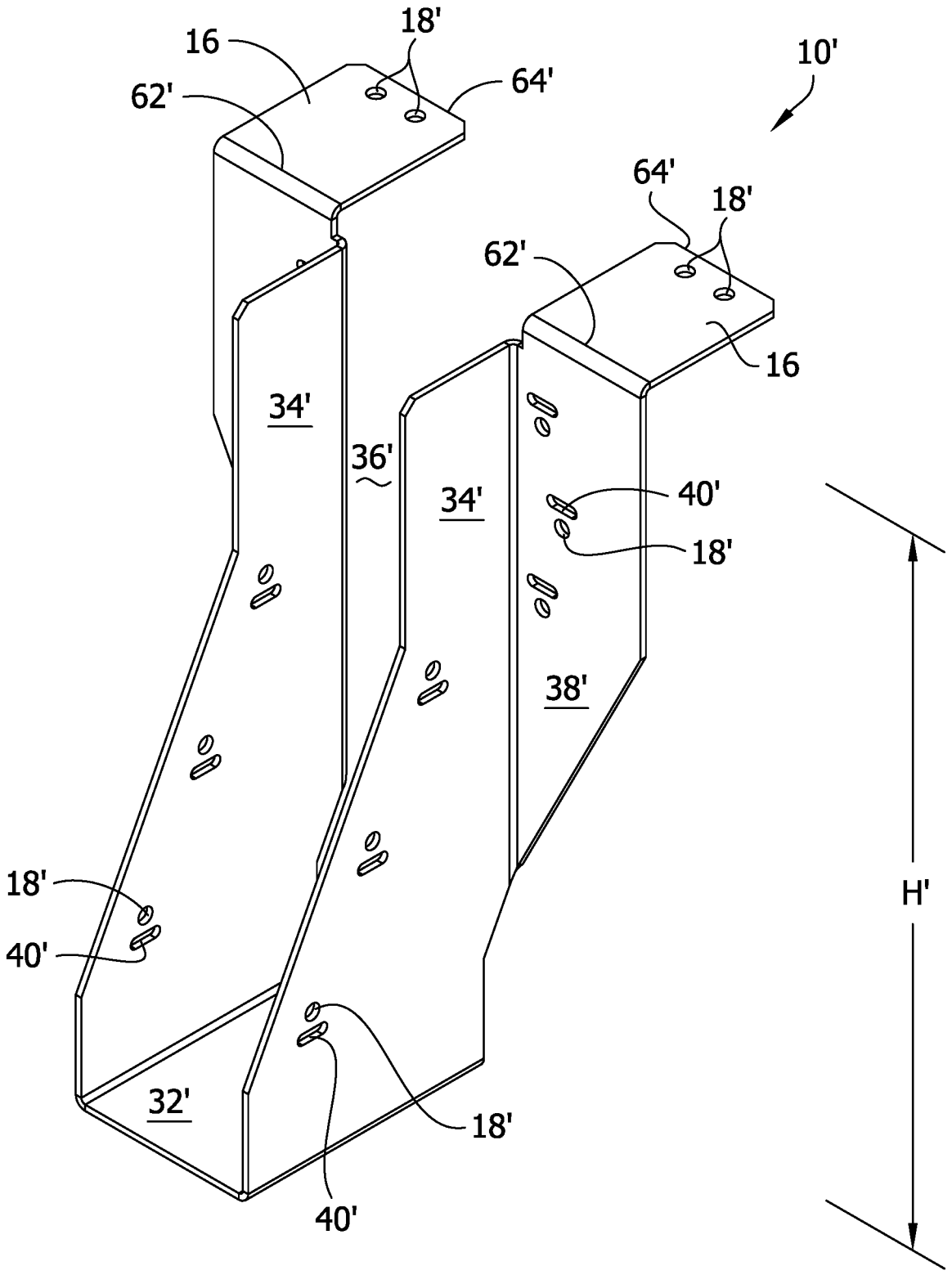
FIG. 10 is a perspective of a hanger of another embodiment.

Referring to FIG. 10, another embodiment of a hanger is indicated generally at 10'. The hanger 10' is substantially similar to hanger 10 of the first embodiment. However, hanger 10' differs from hanger 10 in that a height H' of the hanger 10' is longer than the height H of hanger 10. In one embodiment, the hanger 10' has a height H of about 12 inches (30 cm). Additionally, the shapes and/or dimensions of the side panels 34' and back panels 38' are different from the side panels 34 and back panels 38 of hanger 10. Also, the back panels 38' have three fastener holes 18' and three associated energy dissipation slots 40'. However, the hanger 10' functions to reduce shear lag in the same manner as hanger 10.

Having described the invention in detail, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above products without departing from the scope of the invention, it is intended that all matter contained in the above description and shown in the accompanying drawings shall be interpreted as illustrative and not in a limiting sense.

What is claimed is:

1. An anti-shearing construction connector for connecting a first structural member to a second structural member using one or more fasteners so as to inhibit shearing off said one or more fasteners by the construction connector, the construction connector comprising:

a first connection portion configured to attach to the first structural member; and a second connection portion connected to the first connection portion and configured to be attached to the second structural member using said one or more fasteners for transferring loads between the first and second structural members when the construction connector connects the first and second structural members, the second connection portion including one or more yieldable portions, each yieldable portion partially defining an aperture in the second connection portion, the aperture configured to receive one of said one or more fasteners to attach the second connection portion to the second structural member, each yieldable portion being configured to change a dimension of the aperture by deforming at a load that is less than a shear load capacity of the fastener received through the aperture when the fastener engages the yieldable portion and less than a shear load capacity of the second connection portion adjacent to the yieldable portion;

wherein the second connection portion further includes a slot adjacent to each yieldable portion opposite the aperture;

wherein the yieldable portion has a dimension extending in a first direction between the aperture and the slot, the dimension of the yieldable portion being less than a diameter of the aperture;

wherein the slot has a height extending generally parallel to the first direction and a width extending generally perpendicularly to the first direction, the height of the slot being less than the diameter of the aperture so that the fasteners are inhibited from being received in the slot, the width of the slot being greater than the diameter of the aperture.

2. The construction connector of claim 1, wherein each yieldable portion is configured to increase a dimension of the aperture by deforming at the load that is less than the shear load capacity of the fastener received through the aperture.

3. The construction connector of claim 1, wherein the yieldable portion is further configured to change a shape of the aperture by deforming at the load that is less than the shear load capacity of the fastener received through the aperture.

4. The construction connector of claim 1, wherein each yieldable portion is sized and shaped to resist a load prior to deforming that is between about 75% and about 90% of the shear load capacity of the fastener.

5. The construction connector of claim 1, wherein each yieldable portion and second connection portion are formed as one piece of material.

6. The construction connector of claim 5, wherein each yieldable portion has a dimension extending in a direction that is radially outward from the aperture, the dimension of the yieldable portion being less than a diameter of the aperture.

7. The construction connector of claim 1, wherein the first connection portion further includes one or more yieldable portions, each yieldable portion partially defining an aperture in the first connection portion, the aperture configured to receive one of said one or more fasteners to attach the first connection portion to the first structural member, each yieldable portion being configured to change a dimension of the aperture by deforming at the load that is less than a shear load capacity of the fastener received through the aperture when the fastener engages the yieldable portion.

8. The construction connector of claim 1, wherein a portion of the yieldable portion is configured to move into the slot when the yieldable portion deforms.

9. The construction connector of claim 1 wherein the yieldable portion is configured to deform without breaking at a load that is less than a shear load capacity of the fastener received through the aperture.

10. A connector for supporting a first structural member by transferring a load exerted by the first structural member to a second structural member, the construction connector comprising:

a first connection portion configured to attach to the first structural member so that the first structural member exerts the load on the first connection portion; and a second connection portion fixed to the first connection portion so that the load exerted by the first structural member on the first connection portion is exerted on the second connection portion, the second connection portion configured to attach to the second structural member so that the second connection portion exerts the load on the second structural member, the second connection portion comprising:

an aperture configured to receive a fastener to attach the second connection portion to the second structural member; and a yieldable portion partially defining the aperture and selected to deform at a deformation load that is less than a shear load capacity of the fastener received through the aperture when the yieldable portion engages the fastener, the yieldable portion being positioned relative to the aperture so that at least a portion of the load is exerted on the fastener by the yieldable portion when the second connection portion exerts the load on the second structural member;

wherein the second connection portion further includes a slot adjacent to the yieldable portion opposite the aperture;

wherein the yieldable portion has a dimension extending in a first direction between the aperture and the slot, the dimension of the yieldable portion being less than a diameter of the aperture;

wherein the slot has a height extending generally parallel to the first direction and a width extending generally perpendicularly to the first direction, the height of the slot being less than the diameter of the aperture so that the fasteners are inhibited from being received in the slot, the width of the slot being greater than the diameter of the aperture.

11. The construction connector of claim 10, wherein the yieldable portion is positioned above the aperture.

12. The construction connector of claim 10, wherein the yieldable portion is positioned below the aperture.

13. The construction connector of claim 10, wherein each yieldable portion is configured to resist a load prior to deforming that is between about 75% and about 90% of the shear load capacity of the fastener.

14. The construction connector of claim 10, wherein the first connection portion further includes:

an aperture configured to receive a fastener to attach the first connection portion to the first structural member; and a yieldable portion partially defining the aperture and selected to deform at a deformation load that is less than a shear load capacity of the fastener received through the aperture when the yieldable portion engages the fastener, the yieldable portion being positioned relative to the aperture so that at least a portion of the load is exerted on the yieldable portion by the fastener when the first structural member exerts the load on the first connection portion.

15. A connector for connecting a first structural member to a second structural member using one or more fasteners, the construction connector comprising:

a first connection portion configured to attach to the first structural member; and a second connection portion connected to the first connection portion and configured to attach to the second structural member, the second connection portion defining:

an aperture configured to receive one of the fasteners to attach the second connection portion to the second structural member; and a slot adjacent the aperture, the slot being sized and shaped so that the fasteners are inhibited from being received in the slot, the slot and the aperture being shaped and arranged relative to each other to define a yieldable portion of the second connection portion selected to deform at a load that is less than the shear load capacity of the fastener when received through the aperture for connecting the construction connector to the second structural member;

wherein the slot has a height in a vertical direction and a width in a horizontal direction, the slot being spaced from the aperture by a distance less than a diameter of the aperture in the vertical direction, the height of the slot being less than the diameter of the aperture so that the fasteners are inhibited from being received in the slot, the width of the slot being greater than the diameter of the aperture.

* * * * *